US009216583B2

(12) United States Patent
Aoki et al.

(10) Patent No.: US 9,216,583 B2
(45) Date of Patent: Dec. 22, 2015

(54) LIQUID CONTAINER, ADAPTER, AND LIQUID EJECTION APPARATUS

(71) Applicant: SEIKO EPSON CORPORATION, Tokyo (JP)

(72) Inventors: Yuji Aoki, Nagano (JP); Naoki Naito, Nagano (JP); Takeshi Iwamuro, Nagano (JP); Ryoji Fujimori, Nagano (JP); Keiichiro Yoshino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/660,512

(22) Filed: Mar. 17, 2015

(65) Prior Publication Data

US 2015/0273842 A1 Oct. 1, 2015

(30) Foreign Application Priority Data

Mar. 26, 2014 (JP) ..... 2014-063236

(51) Int. Cl.
*B41J 2/175* (2006.01)

(52) U.S. Cl.
CPC ..... *B41J 2/17503* (2013.01)

(58) Field of Classification Search
CPC ..... B41J 2/175; B41J 2/14; B41J 2/135; B41J 2202/12; B41J 2/14145; B41J 2/1751
See application file for complete search history.

(56) References Cited

U.S. PATENT DOCUMENTS

| | | | | |
|---|---|---|---|---|
| 7,229,162 | B2 * | 6/2007 | Okazawa | B41J 2/055 347/84 |
| 8,336,999 | B2 * | 12/2012 | Matsumoto | B41J 2/17509 347/85 |
| 8,419,173 | B2 * | 4/2013 | Hayashi | B41J 2/175 347/31 |
| 8,672,461 | B2 * | 3/2014 | Igarashi | B41J 2/16526 347/7 |
| 2005/0243148 | A1 | 11/2005 | Miyazawa et al. | |

FOREIGN PATENT DOCUMENTS

| | | | |
|---|---|---|---|
| JP | 2008-265009 | A | 11/2008 |
| WO | 2004/037541 | A1 | 5/2004 |

* cited by examiner

*Primary Examiner* — Lamson Nguyen
(74) *Attorney, Agent, or Firm* — Global IP Counselors, LLP

(57) ABSTRACT

A liquid container is configured to be detachably attached to a liquid container storage section having a liquid supply section, and a damping section including a movement section that seals off one end of a recess space and is movable in a direction of compression in which air of the recess space is compressed, and an urging section that urges the movement section in a direction opposite to the direction of compression. The liquid container includes a liquid lead-out section configured to be connected to the liquid supply section, and an abutment section arranged on a same side as a side section to which the liquid lead-out section is provided, and abuttable against the movement section in a direction of mounting that matches the direction of compression when the liquid container moves in the direction of mounting with respect to the liquid container storage section.

11 Claims, 10 Drawing Sheets

LIQUID CONTAINER, ADAPTER, AND LIQUID EJECTION APPARATUS

CROSS-REFERENCE TO RELATED APPLICATIONS

This application claims priority to Japanese Patent Application No. 2014-063236 filed on Mar. 26, 2014. The entire disclosure of Japanese Patent Application No. 2014-063236 is hereby incorporated herein by reference.

BACKGROUND

1. Technical Field

The present invention relates to a container for storing a liquid to be ejected from a liquid ejection section, or to an adapter, or to a liquid ejection apparatus to which they are detachably attached.

2. Related Art

A liquid ejection apparatus provided with a liquid ejection section for ejecting a liquid such as ink has conventionally been used. JP-A-2008-265009 (Patent document 1) discloses one example of this type of liquid ejection apparatus (an inkjet recording apparatus). In patent document, an ink container storage chamber for storing an ink container is provided to the interior of a pressurization tank. The ink container is flexible, and is arranged on a tray so as to take a flat shape overall. The ink container is laid flat on the tray and is placed in and removed from the ink container storage chamber along with the tray in this state. An ink outflow port (ink lead-out section) is provided to one end of the ink container. The ink outflow port is connected to an ink supply port provided to the ink container storage chamber, and is connected via the ink supply port to an ink supply path that goes toward the liquid ejection section.

SUMMARY

In a liquid ejection apparatus where a large-volume ink container is used, an ink container having a considerable weight is placed in and removed from the ink container storage chamber. For this reason, there is a large impact when the ink container collides with an ink container storage section (ink container storage chamber), due to inertia. As such, there is the risk that the impact upon collision could cause damage to the ink lead-out section provided to the ink container, or an ink container storage section-side site to which the ink lead-out section is connected. In particular, the impact is very considerable in a case where the ink container is mounted at an angle, and the risk for damage is also considerable.

One advantage of the present invention, in view of such matters, is to prevent damage due to an impact to a container section or to a container for storing a liquid such as ink when the container is placed in the storage section.

In order to solve the problem above, the present invention is a liquid container configured to be detachably attached to a liquid container storage section having a liquid supply section, and a damping section including a movement section that seals off one end of a recess space and is movable in a direction of compression in which air of the recess space is compressed, and an urging section that urges the movement section in a direction opposite to the direction of compression. The liquid container includes a liquid lead-out section configured to be connected to the liquid supply section, and an abutment section arranged on a same side as a side section to which the liquid lead-out section is provided, and abuttable against the movement section in a direction of mounting that matches the direction of compression when the liquid container moves in the direction of mounting with respect to the liquid container storage section.

Also, in order to solve the problem above, the present invention is an adapter for positioning a liquid storage body for storing a liquid on a liquid container storage section having a liquid supply section, and a damping section including a movement section that seals off one end of a recess space and is movable in a direction of compression in which air of the recess space is compressed, and an urging section that urges the movement section in a direction opposite to the direction of compression. The adapter includes a liquid lead-out section configured to be connected to the liquid supply section, and an abutment section formed on a same side as a side section to which the liquid lead-out section is provided, and abuttable against the movement section in a direction of mounting that matches the direction of compression when the liquid container moves in the direction of mounting with respect to the liquid container storage section.

Also, in order to solve the problem above, a liquid ejection apparatus of the present invention includes a liquid ejection section, a liquid container configured to store a liquid that is supplied to the liquid ejection section, and a liquid container storage section configured to be detachably attached to the liquid container. The liquid container storage section has a liquid supply section configured to feed the liquid out to the liquid ejection section, and a damping section including a movement section that seals off one end of a recess space and is movable in a direction of compression in which air of the recess space is compressed, and an urging section that urges the movement section in a direction opposite to the direction of compression. The liquid container has a liquid lead-out section configured to be connected to the liquid supply section, and an abutment section formed on a same side as a side section to which the liquid lead-out section is provided, and abuttable against the movement section in a direction of mounting that matches the direction of compression when the liquid container moves in the direction of mounting with respect to the liquid container storage section.

According to the present invention, a damping action that acts when the air of the recess space is compressed when the movement section is moving makes it possible to reduce the inertial force of when the liquid container is being mounted onto the liquid container storage section. As such, the impact of when the liquid container and the liquid container storage section collide together can be reduced, and the risk of damage to the liquid container and to the liquid container storage section when the liquid container is being mounted can be reduced.

In the present invention, preferably, the abutment section abuts against the movement section before the liquid supply section is connected to the liquid lead-out section. So doing causes the damping action to act before the liquid supply section is connected to the liquid lead-out section, and reduces the inertial force. As such, the impact can be reliably reduced for when the liquid supply section is connected to the liquid lead-out section. Accordingly, there is even less risk of damage to the liquid supply section and to the liquid lead-out section.

The present invention is preferably provided with a recess that is depressed in a direction opposite to the direction of mounting, the abutment section being provided to a bottom surface of the recess. So doing makes it possible to have a movement stroke of the movement section be as long as the depth of the recess. As such, the damping action can be increased and the impact upon collision can be further reduced. Accordingly, the risk of damage can be further reduced.

In the present invention, preferably, there are at least two abutment sections that are provided to the side section to which the liquid lead-out section is provided, and are arranged equidistantly across the liquid lead-out section. So doing causes the damping force to be generated at symmetrical positions with respect to the liquid lead-out section and the liquid supply section. As such, it is possible to prevent the pressing and moving of the movement section by the abutment section from causing the liquid container to become inclined with respect to the liquid container storage section and creating misalignment between the liquid lead-out section and the liquid supply section. Accordingly, the risk of damage to the liquid supply section and to the liquid supply section upon collision can be further reduced.

Preferably, the present invention is mountable onto a tray that is configured to be placed in or taken out from the liquid container storage section, and is provided with a fit-receiving section configured to fit, in a direction intersecting with the direction of mounting, onto a fitting section provided to a side section on a side of the liquid supply section in the tray, the fit-receiving section overlapping with a straight line that passes through a center of the two abutment sections arranged equidistantly across the liquid lead-out section as viewed in the direction of mounting. So doing makes it possible to prevent the liquid container from being misaligned in an anti-direction of mounting (direction opposite to the direction of mounting) with respect to the tray when the liquid container is being mounted onto a liquid container storage section. As such, the liquid lead-out section and the liquid supply section can be prevented from entering a failed connection state.

According to the present invention, the impact of when the liquid container and the liquid container storage section collide together can be reduced, and the risk of damage to the liquid container and to the liquid container storage section when the liquid container is being mounted can be reduced.

BRIEF DESCRIPTION OF THE DRAWINGS

Referring now to the attached drawings which form a part of this original disclosure.

DETAILED DESCRIPTION OF EMBODIMENTS

Embodiments of a liquid ejection apparatus to which the present invention has been applied and of a liquid container that is installed/detached to/from a liquid container storage section thereof shall now be described below, with reference to the accompanying drawings. The embodiments that follow are the result of applying the present invention to an inkjet printer and to an ink container that is installed/detached to/from an ink container storage section thereof; however, the present invention could also be applied to a liquid ejection apparatus that ejects a liquid other than ink, and to a liquid container thereof.

(Overall Configuration)

Figure 1A:
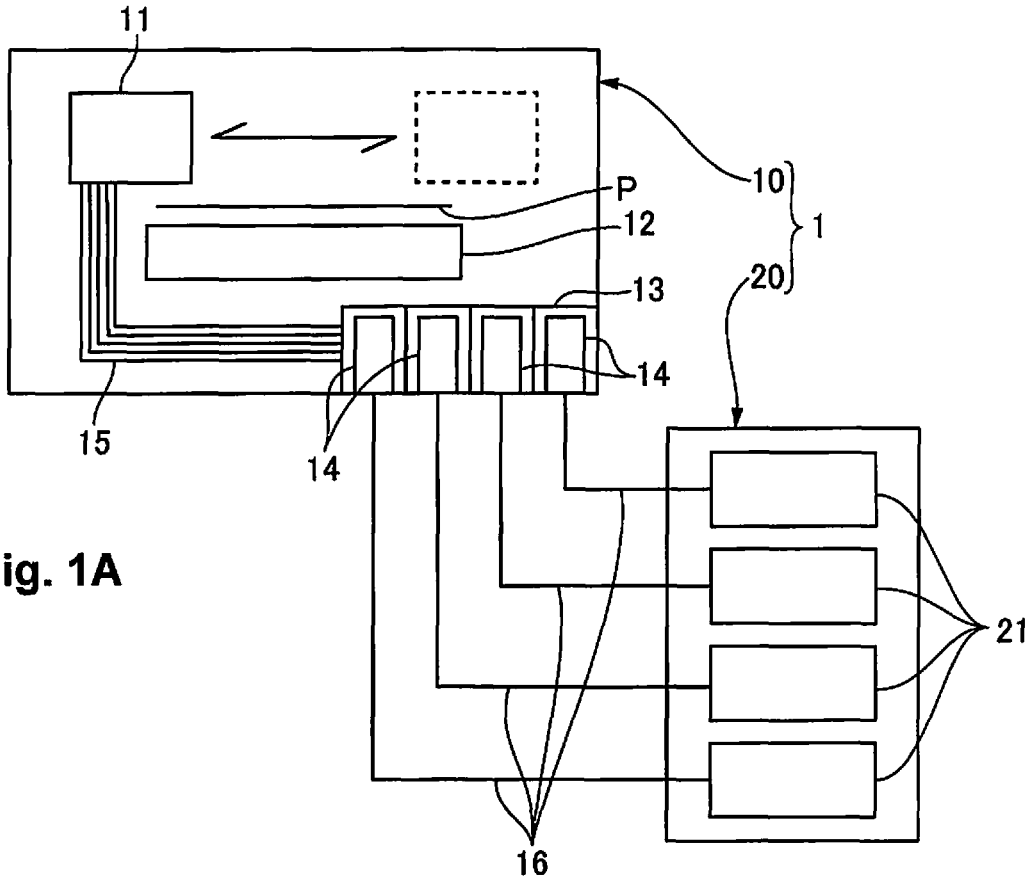
FIGS. 1A and 1B are descriptive views schematically illustrating principal parts of an inkjet printer to which the present invention has been applied.
Figure 1B:
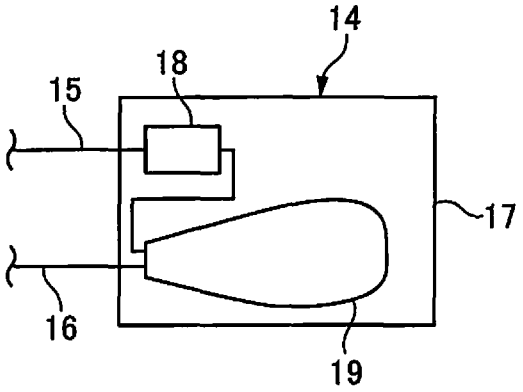

FIGS. 1A and 1B are descriptive views schematically illustrating principal parts of a printer to which the present invention has been applied, where FIG. 1A illustrates the overall configuration and FIG. 1B illustrates the configuration of an intermediate tank. A printer 1 (liquid ejection apparatus) is an inkjet printer, and is provided with a printer main body 10 and an ink storage unit 20. The printer main body 10 uses ink, which is one example of a liquid, to print onto a print medium P. The ink storage unit 20 retains ink that is supplied to the printer main body 10.

Provided to the interior of the printer main body 10 are an inkjet head 11 (liquid ejection section), a platen unit 12, a medium conveyance mechanism (not shown), and a head movement mechanism (not shown), inter alia. The print medium P is conveyed along a platen surface by the medium conveyance mechanism, which is provided with a paper feed roller, a paper feed motor, and the like. The inkjet head 11 is moved reciprocatingly in a direction transverse to the platen surface by the head movement mechanism. The head movement mechanism is provided with, inter alia, a carriage on which the inkjet head 11 is mounted, a carriage guide shaft extending in the direction transverse to the platen surface, the carriage movement mechanism for moving the carriage reciprocatingly along the carriage guide shaft, and a carriage motor. The print medium P passes over the platen surface and, at this time, undergoes printing by the inkjet head.

The printer main body 10 is also provided with cartridge mounting sections 13. Mounted onto the cartridge mounting sections 13 are four intermediate tanks 14, one each for storing ink of a respective color—cyan ink C, magenta ink M, yellow ink Y, and black ink Bk. The inkjet head 11 and the intermediate tanks 14 are connected by flexible supply tubes 15. The ink storage unit 20, in turn, is provided with the same number of main tanks 21 as the number of intermediate tanks 14 (which, in the present embodiment, is four). The four main tanks 21 are supported by a support frame of the ink storage unit 20. The main tanks 21 are pressurized by pressurized air that is fed in from a pressurization section (not shown) provided to the printer main body 10. The intermediate tanks 14 and the main tanks 21 are connected by flexible supply tubes 16. The number of intermediate tanks 14 and main tanks 21 need not be four, and the type(s) of ink being stored may be different from the four colors of ink mentioned above.

As illustrated in FIG. 1B, the intermediate tanks 14 are provided with a cartridge-type case 17, and a filter 18 and ink container 19 that are arranged in the interior of the case 17. The ink container 19 is a flexible tube container; for example, a blow bottle made of resin is used. When the intermediate tanks 14 are mounted onto the cartridge mounting sections 13, an ink supply needle is inserted into a connection port provided to the case 17. This causes the ink containers 19 and the supply tubes 15 to be connected via the filters 18, and causes the ink containers 19 and the supply tubes 16 to be connected. As such, it becomes possible for ink that is retained in the main tanks 21 to be supplied to and temporarily stored in the intermediate tanks 14, and then supplied from the intermediate tanks 14 to the inkjet head 11.

(Main Tanks)

Figure 2:
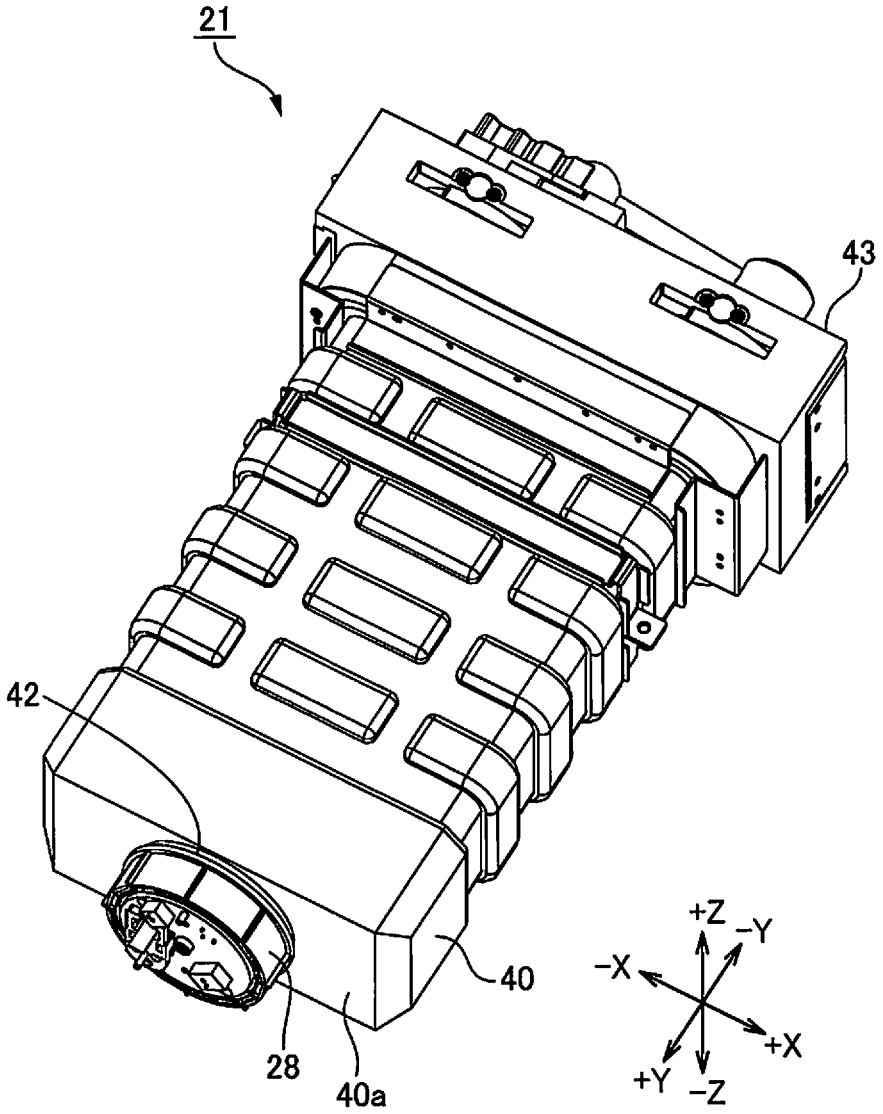
FIG. 2 is an external perspective view of a main tank.
Figure 3:
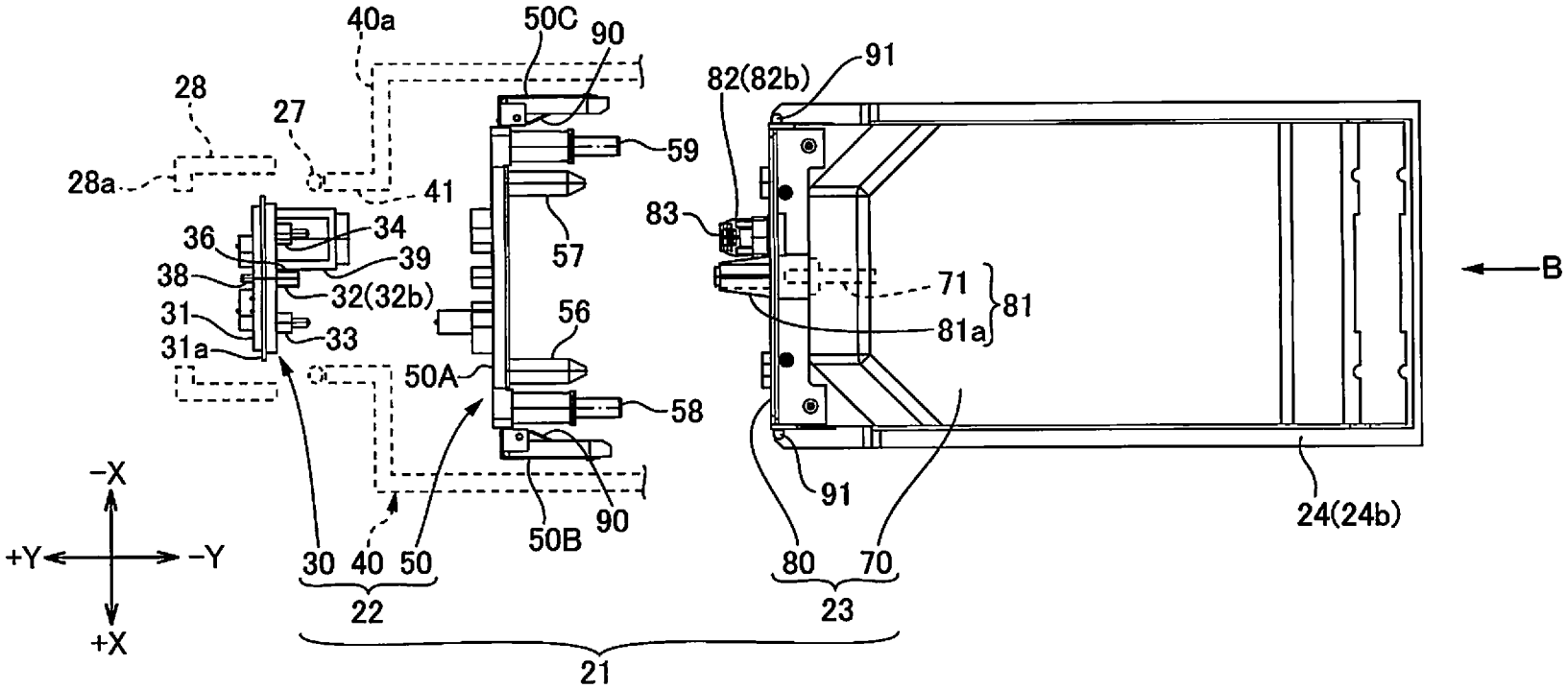
FIG. 3 is an exploded plan view of a main tank.
Figure 4:
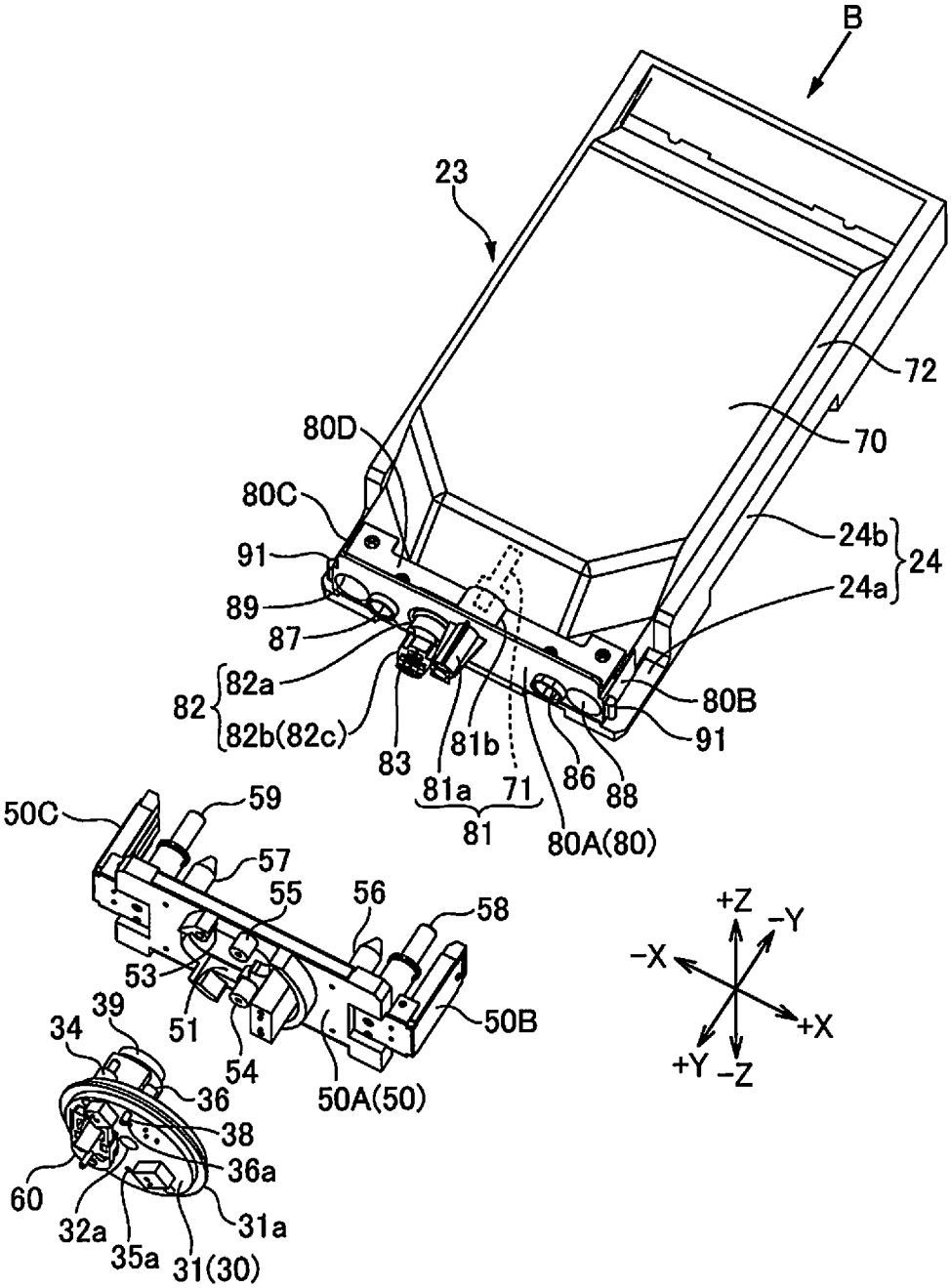
FIG. 4 is an exploded perspective view of a main tank.

FIG. 2 is an external perspective view of a main tank 21, and FIG. 3 is an exploded plan view of a main tank 21. FIG. 4 is an exploded perspective view of a main tank 21, and illustrates a state where a blow tank has been omitted. The main tank 21 is provided with: an ink container storage section 22 (liquid container storage section), which is an enclosed container; an ink container 23 (liquid container), which is removably mounted in the interior thereof; and a tray 24 on which the ink container 23 is placed. The ink container storage section 22 is provided with the cover body 30, which is circular, as well as a blow tank 40 and a mounting member 50. The mounting member 50 is arranged on a reverse side of the cover body 30 in the interior of the blow tank 40. Hereinafter, in the present specification, three directions orthogonal to one another shall be termed the container width direction X, the container longitudinal direction Y, and the container vertical direction Z. One side and the other side of the container width direction X shall be the +X direction and the −X direction, one side and the other side of the container longitudinal direction Y shall be the +Y direction and the −Y direction, and one side and the other side of the container vertical direction Z shall be the +Z direction and the −Z direction.

(Opening and Closing Structure of the Ink Container Storage Section)

The blow tank 40 is a container made of resin that is of a substantially rectangular parallelepiped shape which is long in the container longitudinal direction Y. Formed in the blow tank 40 is a circular opening 41 (see FIG. 3) that penetrates through a container front surface section 40*a* located on a +Y direction-side end. At an opening edge of the circular opening 41, a cylindrical section 42 protruding out to the +Y direction side is formed. The cover body 30 is mounted onto a distal end of the cylindrical section 42, and seals the circular opening 41 in an airtight state. The cover body 30 is provided with a substantially disc-shaped covering body section 31, and a flange section 31*a* protrudes out in an annular shape from an outer peripheral end surface of the covering body section 31. Arranged between the flange section 31*a* and a distal end surface of the cylindrical section 42 is an O-ring 27 (see FIG. 3). An outer ring 28 (see FIGS. 2 and 3) is mounted onto the outer peripheral side of the cover body 30 and the cylindrical section 42. The outer peripheral surface of the cylindrical section 42 and the inner peripheral surface of the outer ring 28 face one another in the radial direction, an external thread section being formed on one and an internal thread section being formed on the other. The outer ring 28 is mounted so that there is meshed engagement between these threaded sections. An annular section 28*a* that protrudes out at the inner peripheral side is formed a +Y direction-side end of the outer ring 28. When the outer ring 28 is tightened, the annular section 28*a* presses on the flange section 31*a* from the +Y direction side. The gap between the flange section 31*a* and the cylindrical section 42 is thereby sealed with the O-ring 27.

In turn, a rear-side opening (not shown) that opens in the −Y direction is formed at an end of the opposite side to the circular opening 41 in the blow tank 40, and an opening and closing door 43 that opens and closes this rear-side opening is installed. The opening and closing door 43 is opened and closed by swinging about one end side in the container width direction X. The ink container 23 and the tray 24 are placed in and taken out inside the blow tank 40 from the rear-side opening by opening the opening and closing door 43. When the opening and closing door 43 is closed, the rear-side opening is sealed off in an airtight state.

(Liquid Supply Section)

Figure 5B:
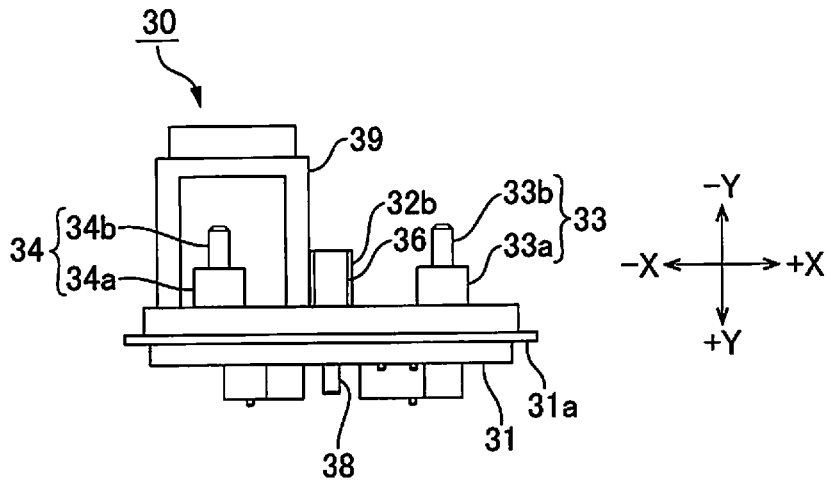
FIGS. 5A, 5B and 5C are a front view and side views of a cover body.
Figure 5A:
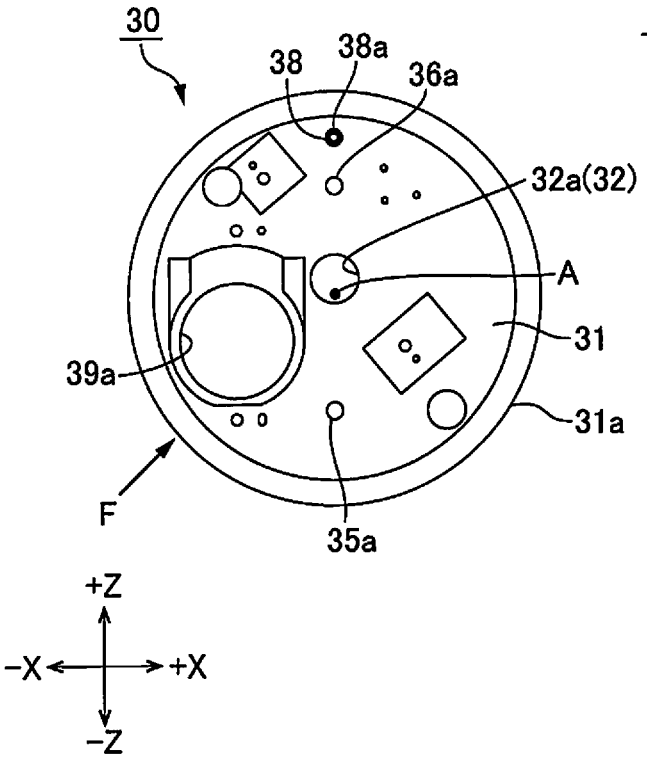
Figure 5C:
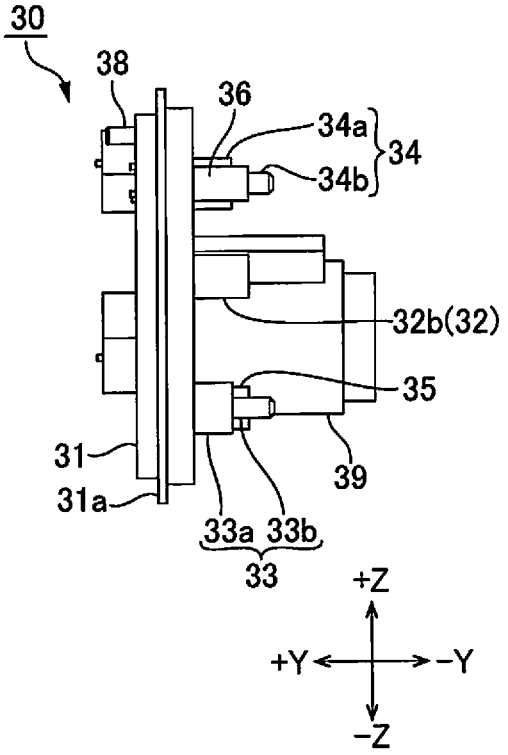
Figure 6:
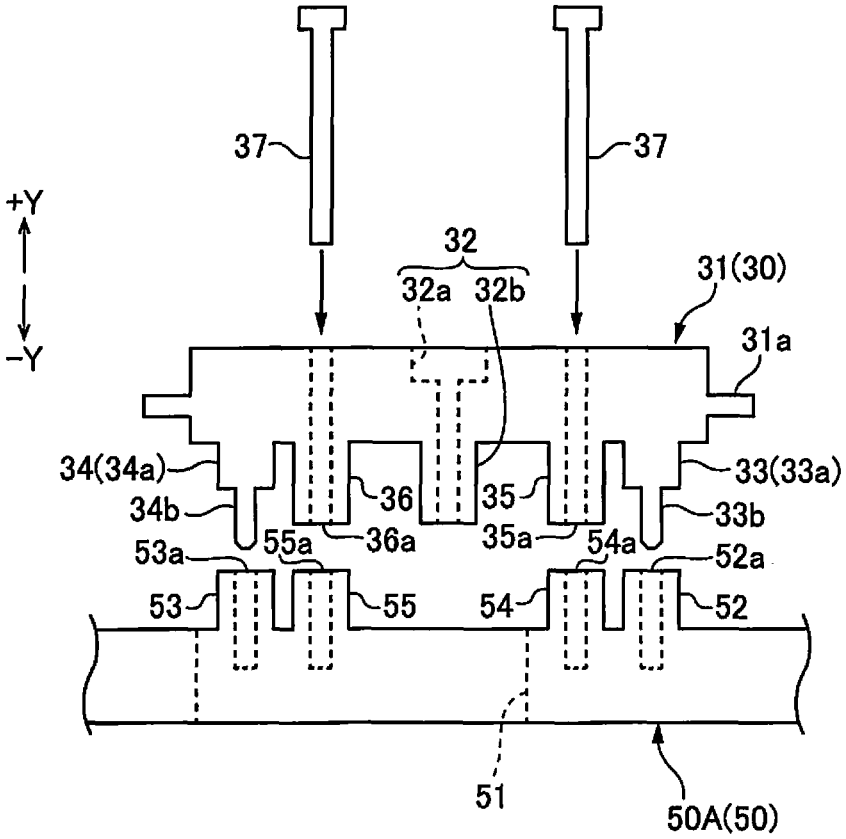
FIG. 6 is a descriptive view schematically illustrating a fixation structure of a cover body and mounting member.

FIGS. 5A, 5B and 5C are a front view and side views of the cover body 30, where FIG. 5A is a front view as seen from the +Y direction side, FIG. 5B is a side view as seen from the +Z direction side, and FIG. 5C is a side view as seen from the +X direction side. FIG. 6 is a descriptive view schematically illustrating a fixation structure of the cover body 30 and the mounting member 50 (a view as seen from the arrow F direction in FIG. 5A), and illustrates a state in which the mounting member 50 and the cover body 30 are separated in the container longitudinal direction Y.

The cover body 30 is mounted in a state of being rotatable about a central axis of the cylindrical section 42, with respect to the circular opening 41 of the blow tank 40. Provided to the cover body 30 is an ink supply section 32 (liquid supply section), at a position that is slightly offset from a center of rotation A thereof (see FIG. 5A). The ink supply section 32 is provided with a connection port 32*a* that opens to a +Y direction-side surface of the covering body section 31, and a protruding section 32*b* protruding out in the −Y direction from a position of the reverse side of the connection port 32*a* in the covering body section 31. The supply tube 16 constituting the ink flow path to/from the intermediate tank 14 is connected to the connection port 32*a*. The ink supply needle (not shown) is provided to a distal end of the protruding section 32*b*, and an ink flow path creating communication between the connection port 32*a* and the ink supply needle is formed in the interior of the protruding section 32*b*.

The mounting member 50, in turn, is provided with a mounting member body section 50*a* of a substantially rectangular shape that is long in the container width direction X, and end plate sections 50B, 50C provided to two ends of the container width direction X of the mounting member body section 50A. The mounting member body section 50A has formed thereon a through section 51 at a region overlapping in the container longitudinal direction Y with the ink supply section 32. The through section 51 penetrates in the container longitudinal direction Y through the mounting member body section 50A. The mounting member 50 and the cover body 30 are arranged with the cylindrical section 42 of the blow tank 40 interposed therebetween, and are fixed by a fixation structure that shall be described below. At this time, the ink supply needle of the ink supply section 32 faces the through section 51, and opposes the ink container 23, which is mounted onto the back surface side of the mounting member body section 50A.

(Fixation Structure of the Cover Body and Mounting Member)

As illustrated in FIGS. 5A to 5C, the covering body section 31 has positioning projections 33, 34 protruding out to the −Y direction side formed thereon at two places symmetrical across the center of rotation A. A proximal end section of the positioning projection 33 is a cylindrical large diameter section 33*a*, and a distal end is a cylindrical small diameter section 33*b* having a smaller diameter than that of the large diameter section 33*a*. Formed at the distal end of the small diameter section 33*b* is a tapered section that decreases in diameter going toward the distal end side. The positioning projection 34 is of the same shape as the positioning projection 33 and is provided with a large diameter section 34*a* and a small diameter section 34*b*. In turn, the mounting member body section 50A has formed thereon cylindrical protruding sections 52, 53 (see FIGS. 4 and 6) at positions that overlap with the positioning projections 33, 34 in the container longitudinal direction Y. The cylindrical protruding sections 52, 53 project out in the +Y direction from the mounting member body section 50A. Positioning holes 52*a*, 53*a* open at a +Y direction-side end surface of the cylindrical protruding sections 52, 53. The positioning holes 52*a*, 53*a* are recesses that do not penetrate through the mounting member body section 50A; the depth thereof is greater than the length of the small diameter sections 33*b*, 34*b*.

The covering body section 31 also has formed thereon boss sections 35, 36 at two places that are apart from the center of rotation A thereof and are different positions in the circumferential direction than the positioning projections 33, 34. The boss sections 35, 36 are arranged at two places that are symmetrical across the center of rotation A, and protrude out in the −Y direction from the covering body section 31. Formed on the cover body 30 are fixation holes 35*a*, 36*a* that penetrate in the container longitudinal direction Y through the covering body section 31 and the boss sections 35, 36. In turn, formed on the mounting member body section 50A are boss sections 54, 55 at positions that overlap in the container longitudinal direction Y with the fixation holes 35*a*, 36*a*. Fixation holes 54*a*, 55*a* open at a +Y direction-side end surface of the boss sections 54, 55. The fixation holes 54*a*, 55*a* are recesses that do not penetrate through the mounting member body section 50A.

The cover body 30 and the mounting member 50 are fixed in a threaded manner that sandwiches, from both sides of the container longitudinal direction Y, the cylindrical section 42 provided to the opening edge of the circular opening 41 of the blow tank 40, as described above. As illustrated in FIG. 6, at the time of fixation, first, the small diameter sections 33*b*, 34*b* of the positioning projections 33, 34 protruding out from the cover body 30 and the positioning holes 52*a*, 53*a* of the cylindrical protruding sections 52, 53 protruding out from the mounting member 50 are made to face one another in the container longitudinal direction Y. Then, the mounting member 50 and the cover body 30 are moved closer together in the container longitudinal direction Y, the small diameter section 33*b* is inserted into the positioning hole 52*a*, and the small diameter section 34*b* is inserted into the positioning hole 53*a*. At this time, the insertion of the small diameter sections 33*b*, 34*b* is guided by the tapered section of the distal end. The distal end surfaces of the boss sections 54, 55 and the distal end surfaces of the boss sections 35, 36 come up against one another, and this causes the mounting member 50 to be positioned in the container longitudinal direction Y with respect to the cover body 30. At this time, the mounting member 50 and the cover body 30 are positioned in a relative rotational direction that is centered on the center of rotation A.

In this manner, when the mounting member 50 is positioned with respect to the cover body 30, then the fixation holes 35*a*, 36*a* on the cover body 30 side and fixation holes 54*a*, 55*a* on the mounting member body section 50A side overlap with one another in the container longitudinal direction Y. In this state, fixation screws 37 are each installed in the fixation holes 35*a*, 36*a* from the outside of the tank (from the +Y direction side), and tightened until distal ends of the fixation screws 37 are threaded into the fixation holes 54*a*, 55*a*. The mounting member 50 is thereby fixed in a threaded manner to the cover body 30.

(Pressurization Hole)

As illustrated in FIGS. 2 to 5C, a pressurization tube connection section 38 that protrudes out in the +Y direction is formed on the cover body 30 radially outwardly of the fixation hole 35*a*. A pressurization hole 38*a* (see FIGS. 5A to 5C) opens at a distal end of the pressurization tube connection section 38. The pressurization hole 38*a* penetrates in the container longitudinal direction Y through the pressurization tube connection section 38 and through the covering body section 31. The pressurization tube connection section 38 is connected with a pressurization tube to the pressurization section of the printer main body 10. When the circular opening 41 and the rear-side opening are blocked off, the interior of the ink container storage section 22 becomes a sealed space. Pressurized air is fed in to this sealed space from the pressurization hole 38*a*, thus pressurizing the ink container storage section 22. As stated above, the fixation holes 54*a*, 55*a* and the positioning holes 52*a*, 53*a* that are used in the fixation of the cover body 30 and the mounting member 50 do not penetrate through the mounting member 50, and therefore the ink container storage section 22 only has two places, the pressurization hole 38*a* and the ink supply section 32, that are sections communicating with the exterior.

(Terminal Arrangement Section)

As illustrated in FIGS. 5A to 5C, a terminal arrangement section 39 is provided to the cover body 30, between the positioning projection 33 and the fixation hole 36*a*. The terminal arrangement section 39 protrudes out in the −Y direction from the covering body section 31. When the cover body 30 and the mounting member 50 are fixed to one another, the terminal arrangement section 39 is arranged at the through section 51 of the mounting member body section 50A, and protrudes into the space where the ink container 23 is arranged. A through section 39*a* that penetrates through in the container longitudinal direction Y is formed in the terminal arrangement section 39. One end of the through section 39*a* opens at a distal end surface (−Y direction-side end surface) of the terminal arrangement section 39, and the other end opens at the +Y direction-side surface of the covering body section 31. A connector unit 60 (see FIGS. 2 and 4) is mounted onto the through section 39*a*. A substrate holder section 82 (see FIGS. 3 and 4) provided to a front end of the ink container 23 is inserted in the +Y direction into the through section 39*a*. FIGS. 5A to 5C illustrates a state where the connector unit 60 has not been mounted onto the terminal arrangement section 39 of the cover body 30. The connector unit 60 and the substrate holder section 82 shall be described in greater detail below.

(Ink Container)

Figure 7:
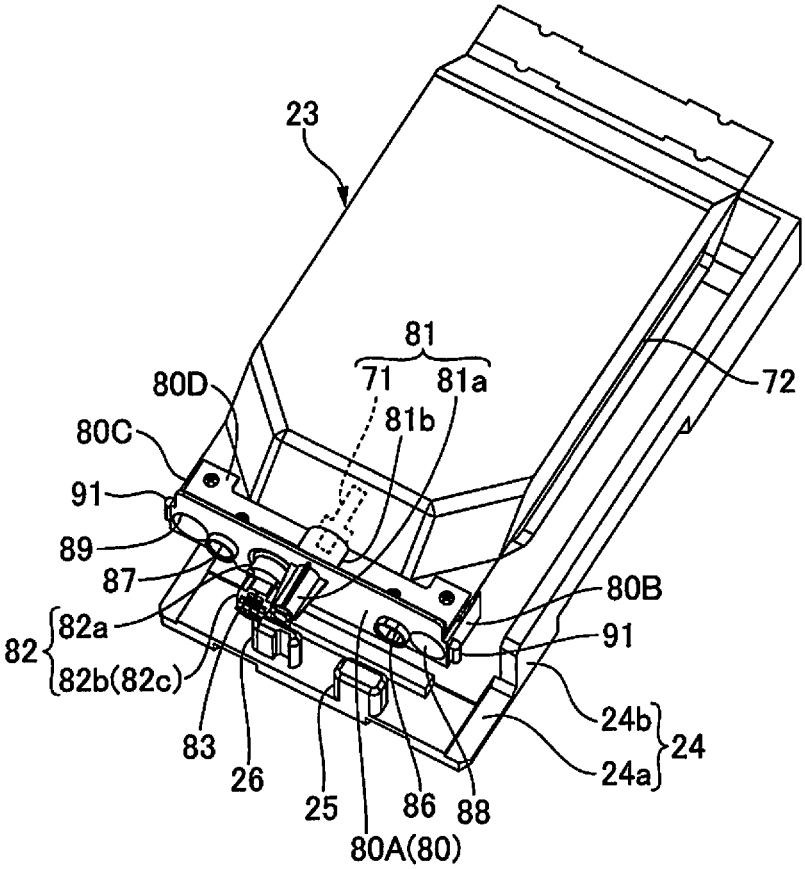
FIG. 7 is a perspective view illustrating a state in which an ink container has been lifted up from a tray.
Figure 8A:
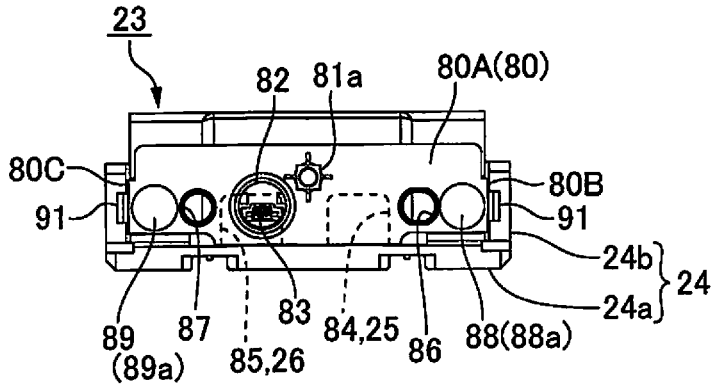
FIGS. 8A and 8B are frontal views of an ink container and a tray.
Figure 8B:
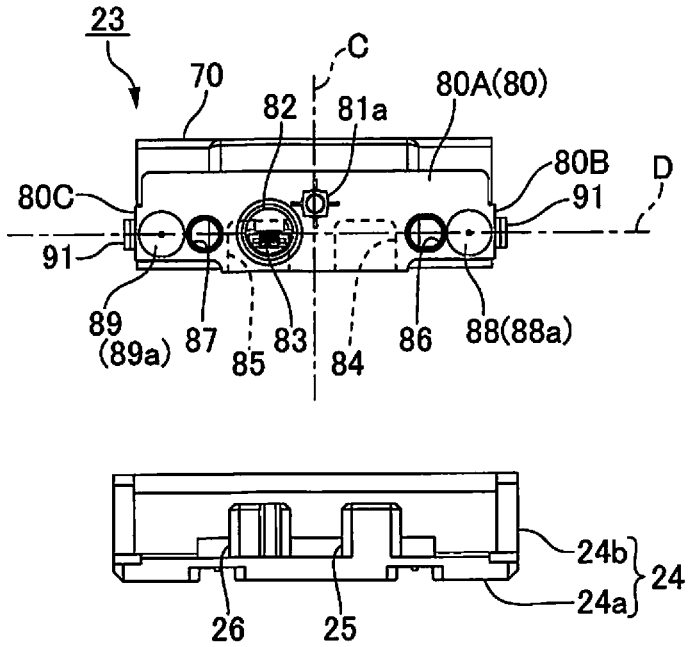

FIG. 7 is a perspective view illustrating a state where the ink container 23 has been lifted up from the tray 24. FIGS. 8A and 8B are frontal views of the ink container 23 and the tray 24. FIG. 8A illustrates a state where the ink container 23 has been placed on the tray 24, and FIG. 8B illustrates a state where the ink container 23 has been lifted up from the tray 24. The ink container 23 is provided with an ink pack 70 (liquid storage body) that is long in the container longitudinal direction Y, and an adapter 80 that is installed on one end of the longitudinal direction of the ink pack 70. The ink container 23 is inserted into the ink container storage section 22 and removed therefrom in a state of having been placed onto the tray 24.

(Ink Pack)

The ink pack 70 (liquid storage body) is a flexible liquid storage bag, in the interior of which the ink is sealed. The planar shape of the ink pack 70 is substantially rectangular, and is sized to fit the tray 24. Formed at a +Y direction-side end of the ink pack 70 is a communication section 71 (see FIG. 7) that creates communication between the inside and outside of the ink pack 70. The ink pack 70 is in a sealed state except for this communication section 71. The communication section 71 is configured by installing a tubular component onto an edge of a flexible bag body. A gusset section 72 is formed on side surfaces of the +X direction side and −X direction side of the ink pack 70. When the ink pack 70 is filled with a large amount of ink, the gusset sections 72 extend in the container vertical direction Z, thus increasing the volume. When the ink is fed out from the ink pack 70 and the amount of ink decreases, the gusset sections 72 collapse back in, thus making the ink pack 70 thinner and reducing the volume.

(Adapter)

The ink container 23 is inserted in a direction of mounting B (which, in the present embodiment, is the +Y direction) from the rear-side opening of the ink container storage section 22 in a state of having been placed on the tray 24 leading with the adapter 80. The adapter 80 is provided with: a front plate section 80A that is long in the container width direction X; end plate sections 80B, 80C that are provided to two ends of the front plate section 80A in the container width direction X; and an ink pack installation section 80D (installation section) provided to a back surface side (−Y direction side) of the front plate section 80A. The ink pack installation section 80D is fixed sandwiching a +Y direction side end margin of the ink pack 70. The end plate sections 80B, 80C extend in the −Y direction from two ends of the front plate section 80A.

(Ink Lead-Out Section)

The front plate section 80A is provided with an adapter front end surface of a substantially rectangular shape facing the +Y direction. A protruding section 81*a* that protrudes out in the +Y direction is formed at the middle of the container width direction X of the front plate section 80A. On the reverse side (−Y direction side) of the protruding section 81*a*, a raised section 81*b* formed at an upper surface (+Z direction surface) of the ink pack installation section 80D extends in the container longitudinal direction Y. An ink flow path that penetrates in the container longitudinal direction Y through the protruding section 81*a* and the raised section 81*b* is provided to the adapter 80, and one end thereof opens at a distal end surface of the protruding section 81*a*. The communication section 71 of the ink pack 70 is connected to the other end of the ink flow path. The protruding section 81*a*, the raised section 81*b*, and the communication section 71 together constitute an ink lead-out section 81 (liquid lead-out section) for leading the ink out from the ink pack 70. The ink lead-out section 81 is connected to the ink supply section 32 of the cover body 30 when the ink container 23 is mounted onto the ink container storage section 22. As such, the ink that is fed out from the ink lead-out section 81 passes through the ink supply section 32 and the supply tube 16 before being supplied to the intermediate tank 14. At this time, when the ink container storage section 22 is pressurized, the ink pack 70 is crushed by the air pressure, thus promoting the feeding out of the ink in the interior.

(Fitting Structure of the Ink Container and Tray)

As illustrated in FIGS. 7, 8A and 8B, the tray 24 bearing the ink container 23 is provided with a bottom plate section 24*a* of a rectangular shape that is long in the container longitudinal direction Y, and a side wall section 24*b* that protrudes out in the +Z direction along end margins of three directions—the +X direction side, the −Y direction side, and the −X direction side—of the bottom plate section 24*a*. In the tray 24, a first fitting section 25 and a second fitting section 26 are provided to the +Y direction-side end margin of the bottom plate section 24*a*. The first fitting section 25 and the second fitting section 26 are protruding sections that protrude out in the +Z direction from the bottom plate section 24*a*, and are arranged apart from one another in the container width direction X.

The ink container 23 is arranged so that the adapter 80 rests on the +Y direction-side end margin of the tray 24. As illustrated in FIGS. 8A and 8B, the front plate section 80A of the adapter 80 has formed thereon a first fit-receiving section 84 at a position overlapping in the container vertical direction Z with the first fitting section 25 and a second fit-receiving section 85 at a position overlapping in the container vertical direction Z with the second fitting section 26, when arranged at the front end of the tray 24. The first fit-receiving section 84 and the second fit-receiving section 85 are both recesses that open in the −Z direction. When the ink container 23 is placed on the tray 24, the first fitting section 25 and the first fit-receiving section 84 fit together in the container vertical direction Z, and the second fitting section 26 and the second fit-receiving section 85 fit together in the container vertical direction Z. The ink container 23 is thereby positioned in the container width direction X and in the container longitudinal direction Y with respect to the tray 24.

(Connection Between a Circuit Substrate and Connection Terminal)

As illustrated in FIG. 7, formed on the front plate section 80A is the substrate holder section 82 (a projection), which protrudes out in the +Y direction, at the −X direction side of the protruding section 81*a*. The substrate holder section 82 is provided with a substantially cylindrical proximal end section 82*a* and a substrate installation section 82*b* protruding further out in the +Y direction from a distal end surface of the proximal end section 82*a*. An inclined surface 82 is formed on a distal end of the substrate installation section 82*b*. The inclined surface 82*c* is a surface obtained by inclining the XZ plane in a sloped direction moving further in the +Y direction while going toward the −Z direction. An O-ring (not shown) is mounted onto an outer periphery of a base of the proximal end section 82*a*. The substrate holder section 82 is inserted into the through section 39*a* (see FIG. 5A) of the terminal arrangement section 39, which protrudes out to the reverse side of the cover body 30, when the ink container 23 is mounted onto the ink container storage section 22. The substrate holder 82 faces, in the container longitudinal direction Y, the connector unit 60 (see FIGS. 4 and 9A to 9B) having been mounted onto the through section 39*a* from the +Y direction.

Figure 9A:
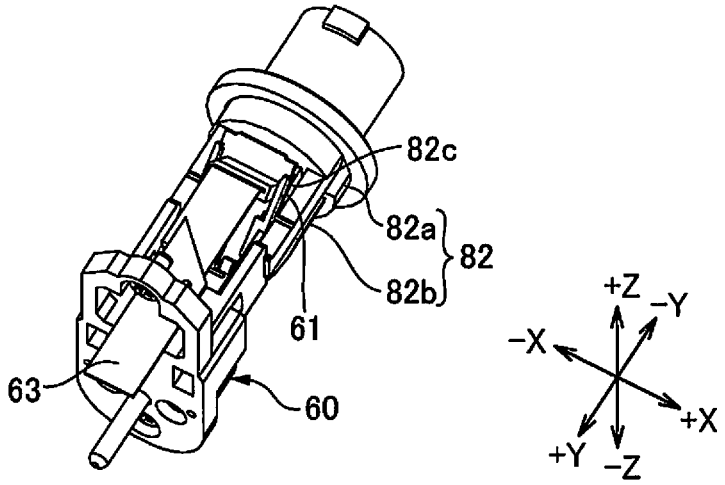
FIGS. 9A, 9B and 9C are perspective views and a side view illustrating a connector unit and a substrate holder section.
Figure 9B:
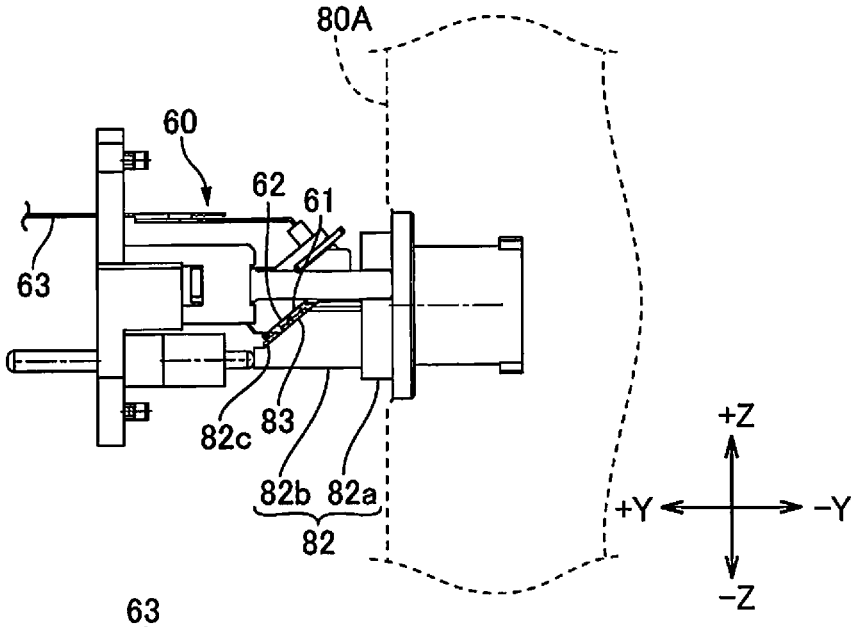
Figure 9C:
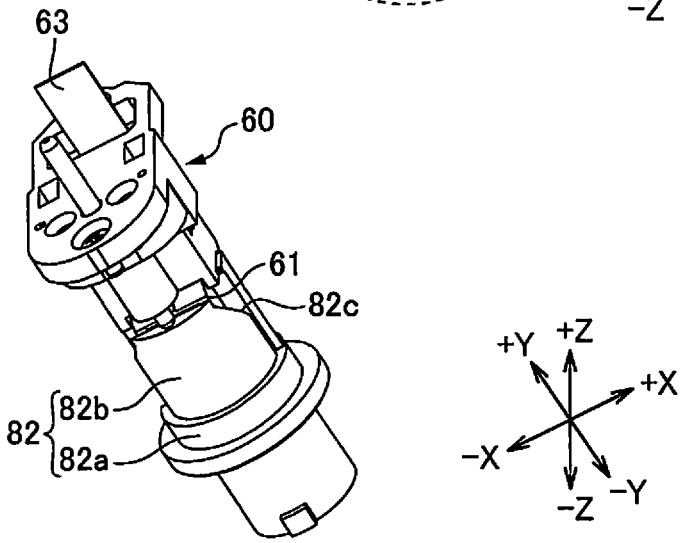

FIGS. 9A, 9B and 9C are perspective views and a side view illustrating the connector unit 60 and the substrate holder section 82, where FIGS. 9A and 9C are perspective views as seen from the +Y direction side, and FIG. 9B is a side view as seen from the +X direction side. The substrate holder section 82 is formed by mounting a separate component onto a mounting hole formed in the front plate section 80A of the adapter 80. The substrate holder section 82 may be formed integrally with the front plate section 80A. A circuit substrate 83 is installed onto the inclined surface 82*c* of the substrate holder section 82. The circuit substrate 83 is one to which a memory element for storing an amount of ink in the ink container 23 and the like is provided. An inclined surface 61 facing the inclined surface 82*c* of the substrate holder section 82 is provided to the connector unit 60. The inclined surface 61 is a surface parallel to the inclined surface 82*c* and, when the connector unit 60 has been mounted onto the terminal arrangement section 39 of the cover body 30, is arranged inside the through section 39*a*. A connection terminal 62 is arranged on the inclined surface 61. A wiring 63 conducting to the connection terminal 62 is routed to a back surface side of the inclined surface 61. The wiring 63 is drawn out to the front surface side of the cover body 30 from the connector unit 60, and is routed to the printer main body 10 side along with the supply tube 16 for ink-supply.

When the ink container 23 is being mounted onto the ink container storage section 22, the movement of the ink container 23 in the direction of mounting B is associated with the insertion of the substrate holder section 82 into the through section 39*a* of the cover body 30. When the mounting of the ink container 23 onto the ink container storage section 22 has been completed, as illustrated in FIGS. 9A to 9C, the state enacted will be one where a terminal section on the circuit substrate 83 arranged on the inclined surface 82*c* of the adapter 80 side is in contact with the connection terminal 62 arranged on the inclined surface 61 of the connector unit 60 side. A point of contact is thereby configured between the circuit substrate 83 and the connection terminal 62.

(Positioning of the Ink Container and Impact Mitigation by Dampers)

A first guide hole 8 and second guide hole 87 (liquid container-side positioning sections) that open in the +Y direction are formed on the front plate section 80A of the adapter 80. The first guide hole 86 and the second guide hole 87 are arranged symmetrically in the container width direction X, where the YZ plane (YZ plane including the C-C line in FIG. 8B) passing through the distal end center of the protruding section 81*a* of the ink lead-out section 81 serves as a reference. The first guide hole 86 is arranged on the +X direction side with respect to the protruding section 81*a*, and the second guide hole 87 is arranged on the −X direction side with respect to the protruding section 81*a*. The first guide hole 86 and the second guide hole 87 penetrate in the container longitudinal direction Y through the front plate section 80A. The first guide hole 86 is a long hole that is elongated in the container width direction X. The second guide hole 87, in turn, is a perfectly circular hole.

On the front plate section 80A of the adapter 80, a first recess 88 is formed further to the +X direction side with respect to the first guide hole 86, and a second recess 89 is formed further to the −X direction side with respect to the second guide hole 87. The first recess 88 and the second recess 89 are recesses that are depressed in the −Y direction. The first recess 88 and the second recess 89 are arranged symmetrically in the container width direction X where the C-C line serves as a reference, and are arranged equidistant from the protruding section 81*a* of the ink lead-out section 81. The first recess 88, the first guide hole 86, the second guide hole 87, and the second recess 89 are arranged on a straight line that is parallel to the container width direction X on the adapter front end surface. The ink lead-out section 81 is arranged more to the container upper side (+Z direction side) than these arrayed positions. A straight line D that passes through the center of a bottom surface 88*a* of the first recess 88 and the center of a bottom surface 89 of the second recess 89 overlaps with the first and second fit-receiving sections 84, 85, which are a site of fitting to the tray 24 in the adaptor 80 (see FIGS. 8A and 8B).

In turn, provided to the mounting member 50 are two guide pins 56, 57 (mounting member-side engagement sections) that protrude out in the −Y direction from the mounting member body section 50A. The guide pin 56 is arranged on the +X direction side with respect to the through section 51, and the guide pin 57 is arranged on the −X direction side with respect to the through section 51. Dampers 58, 59 (damping sections) are arranged outwardly in the container width direction X with respect to the guide pins 56, 57. The damper 58 is arranged on the +X direction side with respect to the guide pin 56, and the damper 59 is arranged on the −X direction side with respect to the guide pin 57. Distal end sections of the dampers 58, 59 protrude out in the −Y direction from the mounting member body section 50A. The damper 58, guide pin 56, guide pin 57, and damper 59 are arranged on a straight line that is parallel to the container width direction X.

The ink container 23 is inserted into the ink container storage section 22 with the adapter 80, which is arranged at the front thereof, facing the mounting member 50 in the container longitudinal direction Y. At this time, the guide pin 56 of the mounting member 50 faces the first guide hole 86 of the adapter 80, and the guide pin 57 of the mounting member 50 faces the second guide hole 87. The damper 58 of the mounting member 50 faces the first recess 88 of the adapter 80, and the damper 59 of the mounting member 50 faces the second recess 89 of the adapter 80. When the ink container 23 is moved in the direction of mounting B, the adapter 80 arranged at the front thereof approaches the mounting member 50. At this time, first, the insertion of the dampers 58, 59 into the first and second recesses 88, 89 is started. Next, the insertion of the guide pins 56, 57 into the first and second guide holes 86, 87 is begun before the distal ends of the dampers 58, 59 come into contact with the bottom surfaces 88*a*, 89*a* of the first and second recesses 88, 89.

The guide pins 56, 57 are inserted into the first and second guide holes 86, 87 while being guided by tapered sections formed at the distal ends. Except for the tapered sections, the guide pins 56, 57 are cylinders of a constant diameter. When the cylindrical portions of the guide pins 56, 57 are inserted into the first and second guide hole 86, 87, then the adapter 80 is positioned on the XZ plane with respect to the mounting member 50. At this time, being a perfect circle, the second guide hole 87 therefore serves as a reference for the positioning. The other one, the first guide hole 86, in turn being a long hole, is therefore a rotation stopper for the adapter 80 with respect to the mounting member 50. After the positioning on the XZ plane by the guide pins 56, 57 and the first and second guide holes 86, 87 has been completed, the distal ends of the dampers 58, 59 abut against the bottom surfaces 88*a*, 89*a* of the first and second recesses 88, 89 (abutment sections: see FIGS. 8A, 8B and 10).

The dampers 58, 59 are air dampers that are extendible and contractible in the container longitudinal direction Y. The configuration of the dampers 58, 59 shall be described in greater detail below. After the dampers 58, 59 have abutted against the bottom surfaces 88*a*, 89*a* of the first and second recesses 88, 89, further movement of the ink container 23 in the direction of mounting B is associated with being squeezed in the +Y direction. At this time, the dampers 58, 59 experience a damping force against the inertial force of the ink container 23 moving in the direction of mounting B. As such, after the dampers 58, 59 have abutted against the bottom surfaces 88*a*, 89*a* of the first and second recesses 88, 89, this damping action reduces the impact force acting on a site of collision between the ink container storage section 22 and the ink container 23.

The ink container 23, as stated above, is provided with the ink lead-out section 81 protruding out in the +Y direction from the adapter 80. In turn, the ink supply section 32 protruding out to the ink container 23 side from the through section 51 of the mounting member 50 is provided to the ink container storage section 22. When the guide pins 56, 57 position the adapter 80 on the XZ plane with respect to the mounting member 50, the ink lead-out section 81 of the ink container 23 faces the ink supply section 32 of the ink container storage section 22. The ink lead-out section 81 is connected to the ink supply section 32 after the state has been reached where the compression of the dampers 58, 59 is started and the damping action comes into play. A seal member (not shown) urged in the +Y direction by a spring seat is provided to a distal end section of the ink lead-out section 81. When the ink lead-out section 81 is not connected to the ink supply section 32, the seal member seals off the ink lead-out section 81, and stops the outflow of ink. When the ink lead-out section 81 is connected to the ink supply section 32, the seal member is pressed and moved in the −Y direction by the ink supply needle and, as a result, the flow path inside the ink lead-out section 81 and the flow path inside the ink supply section 32 are communicated.

After the ink supply section 32 and the ink lead-out section 81 have been connected together, the ink container 23 is further moved in the direction of mounting B (+Y direction). At this stage, the connection terminal 62 held in the cover body 30 of the ink container storage section 22 and the circuit substrate 83 held in the adapter 80 of the ink container 23 are connected. That is to say, when the ink supply section 32 and the ink lead-out section 81 are connected, the substrate holder section 82 for holding the circuit substrate 83 has already been inserted into the distal end side of the through section 39*a* where the connector unit 60 is installed. When the ink container 23 is further moved in the direction of mounting B from this state, first, an O-ring (not shown) mounted onto the proximal end section 82*a* of the substrate holder section 82 is crushed by the distal end surface of the terminal arrangement section 39. This eliminates the communication of the through section 39*a* through to the pressurization space inside the ink container storage section 22, and makes it possible to connect the circuit substrate 83 and the connection terminal 62 outside the pressurization space. Next, inside the through section 39*a*, the connection terminal 62 installed on the inclined surface 61 of the connector 60 and the circuit substrate 83 installed on the inclined surface 82*c* of the substrate installation section 82*b* are contacted. The circuit substrate 83 and the connection terminal 62 are in sliding contact along the direction of inclination of the inclined surfaces 61, 82*c* during contact.

As described above, the ink container 23 is mounted onto the ink container storage section 22 through the following five steps (1) to (5).

(1) Positioning of the tray 24 and the ink container 23 by the fitting sections in two places (2) Positioning of the mounting member 50 and the ink container 23 by the two guide pins 56, 57

(3) Occurrence of the damping action by the dampers 58, 59

(4) Connection of the ink supply section 32 and the ink lead-out section 81

(5) Contact of the connection terminal 62 on the ink container storage section 22 side and the circuit substrate 83 on the ink container 23 side (Retaining Structure for the Ink Container)

When the ink container 23 has been mounted onto the ink container storage section 22, the end plate section 80B of the adapter 80 is located on the inside of the container width direction X of the end plate section 50B of the mounting member 50, and the end plate section 80C is located on the inside of the container width direction X of the end plate section 50C of the mounting member 50. A leaf spring 90 is installed on an inside surface in the container width direction X on the end plate sections 50B, 50C. In turn, a locking section 91, which is a projection that protrudes out from an outside surface in the container width direction X, is formed on the end plate sections 80B, 80C. When the ink container 23 moves in the direction of mounting B within the ink container storage section 22, the leaf springs 90 and the locking sections 91 engage at two places between the end plate section 50B and the end plate section 80B, and between the end plate section 50C and the end plate section 80C. When the five steps (1) to (5) described above have been completed, then the engagement between the leaf springs 90 and the locking sections 91 is also completed, at the two ends of the container width direction X of the ink container 23. The places where the leaf springs 90 and the locking sections 91 are engaged will not be released from engagement by a weak vibration. As such, the leaf springs 90 and the locking sections 91 function as a retainer of the ink container 23 during vibration. These engaging places are, however, easily released from engagement by a force of the degree of when a user pulls on the ink container 23 toward himself. As such, the ink container 23 is easy to replace.

(Dampers)

Figure 10:
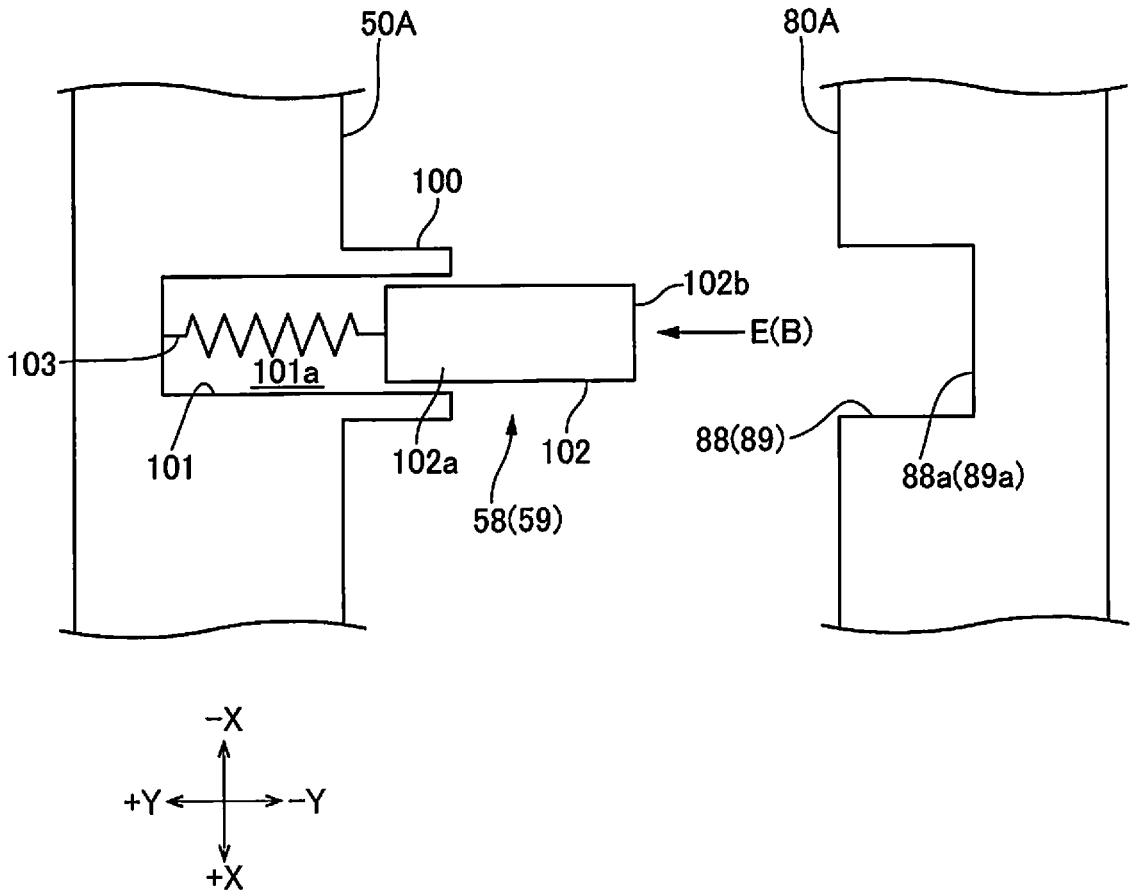
FIG. 10 is a descriptive view schematically illustrating a configuration of a damper.

FIG. 10 is a descriptive view schematically illustrating a cross-sectional configuration of the dampers 58, 59. The dampers 58, 59 are air dampers, where the compression of air produces a damping force. The dampers 58, 59 have the same configuration. A protruding section 100 that protrudes out in the −Y direction is formed at each of the positions of formation of the dampers 58, 59 on the mounting member body section 50A. The damper 58 (59) is provided with a recess 101 that opens at a distal end surface of the protruding section 100, a rectilinear piston 102 (movement section) one end of which is inserted into a space (recess space 101*a*) inside the recess 101, and a coil spring 103 (urging section) that is arranged in the recess space 101*a*. The recess 101 is depressed rectilinearly in the +Y direction. A +Y direction-side end 102*a* of the piston 102 is inserted into the recess space 101*a*. The end 102*a* makes internal contact with an inner peripheral surface of the recess 101, thus sealing the recess space 101*a* in an air-tight state. The piston 102 is above to move reciprocatingly in a direction of compression E in which the air in the recess space 101*a* is compressed, and the opposite direction thereof. The dampers 58, 59 are formed so that the direction of compression E and the direction of mounting B of the ink container 23 match together. In the present embodiment, the direction of compression E and the direction of mounting B are both the +Y direction. The coil spring 103 is a free length when in a state where the piston 102 is not being pressed.

An end 102*b* on the other side of the piston 102 faces the bottom surface 88*a* (89*a*) of the first recess 88 (second recess 89) of the adapter 80. When the ink container 23 moves in the direction of mounting B (+Y direction), the piston 102 abuts against the bottom surface 88*a* (89*a*), and is moved by being compressed in the direction of compression E (+Y direction/direction of mounting B) by the bottom surface 88*a* (89*a*). At this time, the length of the damper 58 (59) shrinks, and the air sealed in the recess 101 is compressed; therefore, a return force attempting to send the piston 102 back is produced in the direction opposite to the direction of compression E. Also, because the coil spring 103 is compressed at this time, the piston 102 is urged in the direction (−Y direction) opposite to the direction of compression E by the coil spring 103. This return force and urging force act on the ink container 23 in the direction opposite to the direction of mounting B, and increase as the piston 102 moves in the +Y direction. When the ink container 23 presses on the damper 58 (59), a damping action by the return force and the urging force comes into play, and the impact of when the ink container 23 collides with the ink container storage section 22 is reduced. This reduces the risk that the impact could damage places of contact (in particular, the ink supply section 32 and the ink lead-out section 81) when the ink container 23 is being mounted onto the ink container storage section 22. The configuration may also be such that a fine communication section passing through to the exterior of the mounting member body section 50A is provided to either the surface of the recess space 101*a* or the opening side, thus allowing the compressed air to gradually exit. This softens the behavior at the time of insertion and reduces the impact upon collision. Also, because the compressed air of the recess space 101*a* exits and the return force is weakened, it becomes possible to better prevent releasing of the engagement between the leaf springs 90 and the locking sections 91.

Effects of the Invention

As described above, the printer 1 of the present embodiment is provided with the main tanks 21 for retaining the ink supplied to the inkjet head 11, and the ink containers 23 are removably mounted onto the ink container storage sections 22 of the main tanks 21. The ink container storage sections 22 are provided with the ink supply sections 32 for supplying the ink to the inkjet head 11 side, and with the dampers 58, 59. The dampers 58, 59 are air dampers where the pistons 102 are arranged so as to seal one end of the recess spaces 101*a* depressed in the direction of mounting B of the ink containers 23, and moving the pistons 102 in the direction of mounting B compresses the air in the recess spaces 101*a* and produces the damping action. In turn, the ink containers 23 are provided with the adapters 80 that are arranged on the side sections of the side of the direction of mounting B onto the ink container storage sections 22, and the ink packs 70 are positioned by these adapters 80. The ink lead-out sections 81 connected to the ink supply sections 32 are formed on the adapters 80, and the first recesses 88 and second recesses 89 that are depressed in the opposite direction to the direction of mounting B are formed on both sides of the ink lead-out sections 81. The bottom surfaces 88*a* of the first recesses 88 and the bottom surfaces 89*a* of the second recesses 89 face the dampers 58, 59 in the direction of mounting B. As such, when moving in the direction of mounting B, the ink containers 23 abut against the pistons 102 of the dampers 58, 59 and move same in the direction of mounting B, thus compressing the air in the recess spaces 101*a*.

Thus, arranging the dampers 58, 59, with which the direction where the damping action is produced (the direction of compression E) matches the direction of mounting B of the ink containers 23, between the ink containers 23 and the ink container storage sections 22 makes it possible to reduce the impact of when the ink containers 23 and the ink container storage sections 22 collide, due to the damping action of the dampers 58, 59. As such, the risk of damage to the ink containers 23 and the ink container storage sections 22 can be reduced. Also, having the abutment sections of the dampers 58, 59 be recesses (the first recesses 88 and the second recesses 89) makes it possible to have the expansion/contraction stroke of the dampers 58, 59 (the movement stroke of the pistons 102) be as long as the depth of the recesses. As such, the damping action can be increased, and the impact applied when the ink containers 23 are being mounted can be further reduced. Accordingly, the risk of damage can be further reduced.

Moreover, in the present embodiment, the damping action of the dampers 58, 59 comes into play before the ink lead-out sections 81 and the ink supply sections 32 are connected, and therefore there is less risk of damage to the ink lead-out sections 81 and the ink supply sections 32. Furthermore, the dampers 58, 59 are arranged equidistant across the ink lead-out sections 81. For this reason, the damping action comes into play at symmetrical positions with respect to the ink lead-out sections 81 and the ink supply sections 32, and the ink containers 23 can be prevented from being inclined with respect to the ink container storage sections 22. Accordingly, misalignment between the ink lead-out sections 81 and the ink supply sections 32 can be prevented, and the risk of damage due to collision when the ink containers 23 are being mounted can be further reduced.

Moreover, in the present embodiment, the ink containers 23 are borne on the trays 24 when placed in or taken out from the ink container storage sections 22, and the configuration between the ink containers 23 and the trays 24 is such that the first fitting sections 25 and second fitting section 26 provided to the trays 24 at the front end in the direction of mounting B and the first fit-receiving sections 84 and second fit-receiving sections 85 provided to the adapters 80 of the ink containers 23 fit together in a direction (the container vertical direction Z) orthogonal to the direction of mounting B. Then, the fitting sections at these two places fit at positions that overlap with the straight lines D connecting the centers of the dampers 58, 59, when seen in the direction of mounting B (+Y direction). This arrangement makes it possible, in a case of action by reaction force coming from the dampers 58, 59 when the ink containers 23 are being mounted, to prevent this reaction force from causing the ink containers 23 to be misaligned in an anti-direction of mounting (−Y direction) with respect to the trays 24. As such, the ink lead-out sections 81 and the ink supply sections 32 can be prevented from entering a failed connection state.

In the embodiment described above, the air dampers (dampers 58, 59) and abutment sections (bottom surface 88*a* of the first recess 88 and bottom surface 89*a* of the second recess 89) were provided in sets of two, but sets of three or more may be provided. In a case where sets of three or more are provided, it is desirable to arrange the sets separately on both sides of the ink lead-out sections 81. It is also desirable for the arrangement to be symmetrical in the container width direction X, where the ink lead-out sections 81 serve as a reference.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid container configured to be detachably attached to a liquid container storage section having a liquid supply section, and a damping section including a movement section that seals off one end of a recess space and is movable in a direction of compression in which air of the recess space is compressed, and an urging section that urges the movement section in a direction opposite to the direction of compression, the liquid container comprising:

a liquid lead-out section configured to be connected to the liquid supply section; and an abutment section arranged on a same side as a side section to which the liquid lead-out section is provided, and abuttable against the movement section in a direction of mounting that matches the direction of compression when the liquid container moves in the direction of mounting with respect to the liquid container storage section.

2. The liquid container as set forth in claim 1, wherein the abutment section abuts against the movement section before the liquid supply section is connected to the liquid lead-out section.

3. The liquid container as set forth in claim 1, further comprising a recess depressed in a direction opposite to the direction of mounting, the abutment section being provided to a bottom surface of the recess.

4. The liquid container as set forth in claim 1, wherein there are at least two abutment sections that are provided to the side section to which the liquid lead-out section is provided, and are arranged equidistantly across the liquid lead-out section.

5. The liquid container as set forth in claim 4, wherein the liquid container is mountable onto a tray that is configured to be placed in or taken out from the liquid container storage section, the liquid container further comprising a fit-receiving section configured to fit, in a direction intersecting with the direction of mounting, onto a fitting section provided to a side section on a side of the liquid supply section in the tray, the fit-receiving section overlapping with a straight line that passes through a center of the two abutment sections arranged equidistantly across the liquid lead-out section as viewed in the direction of mounting.

6. An adapter for positioning a liquid storage body for storing a liquid on a liquid container storage section having a liquid supply section, and a damping section including a movement section that seals off one end of a recess space and is movable in a direction of compression in which air of the recess space is compressed, and an urging section that urges the movement section in a direction opposite to the direction of compression, the adapter comprising:

a liquid lead-out section configured to be connected to the liquid supply section; and an abutment section formed on a same side as a side section to which the liquid lead-out section is provided, and abuttable against the movement section in a direction of mounting that matches the direction of compression when the liquid container moves in the direction of mounting with respect to the liquid container storage section.

7. The adapter as set forth in claim 6, wherein the abutment section abuts against the movement section before the liquid supply section is connected to the liquid lead-out section.

8. The adapter as set forth in claim 6, further comprising a recess depressed in a direction opposite to the direction of mounting, the abutment section being provided to a bottom surface of the recess.

9. The adapter as set forth in claim 6, wherein there are at least two abutment sections that are provided to the side section to which the liquid lead-out section is provided, and are arranged equidistantly across the liquid lead-out section.

10. The adapter as set forth in claim 9, further comprising a fit-receiving section configured to fit, in a direction intersecting with the direction of mounting, onto a fitting section provided to a side section on a side of the liquid supply section in a tray that is configured to be placed in or taken out from the liquid container storage section, the fit-receiving section overlapping with a straight line that passes through a center of the two abutment sections arranged equidistantly across the liquid lead-out section as viewed in the direction of mounting.

11. A liquid ejection apparatus comprising:

a liquid ejection section;

a liquid container configured to store a liquid that is supplied to the liquid ejection section; and a liquid container storage section configured to be detachably attached to the liquid container, the liquid container storage section having a liquid supply section configured to feed the liquid out to the liquid ejection section, and a damping section including a movement section that seals off one end of a recess space and is movable in a direction of compression in which air of the recess space is compressed, and an urging section that urges the movement section in a direction opposite to the direction of compression, the liquid container having a liquid lead-out section configured to be connected to the liquid supply section, and an abutment section formed on a same side as a side section to which the liquid lead-out section is provided, and abuttable against the movement section in a direction of mounting that matches the direction of compression when the liquid container moves in the direction of mounting with respect to the liquid container storage section.

* * * * *